US010468182B2

(12) United States Patent
Yoshizawa et al.

(10) Patent No.: US 10,468,182 B2
(45) Date of Patent: Nov. 5, 2019

(54) RAPIDLY QUENCHED FE-BASED SOFT-MAGNETIC ALLOY RIBBON AND ITS PRODUCTION METHOD AND CORE

(71) Applicant: HITACHI METALS, LTD., Tokyo (JP)

(72) Inventors: Yoshihito Yoshizawa, Mishima-gun (JP); Motoki Ohta, Mishima-gun (JP); Naoki Ito, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 341 days.

(21) Appl. No.: 15/449,420

(22) Filed: Mar. 3, 2017

(65) Prior Publication Data

US 2017/0178805 A1 Jun. 22, 2017

Related U.S. Application Data

(62) Division of application No. 13/981,809, filed as application No. PCT/JP2012/051808 on Jan. 27, 2012, now abandoned.

(30) Foreign Application Priority Data

Jan. 28, 2011 (JP) ..... 2011-016017

(51) Int. Cl.
*H01F 3/04* (2006.01)
*H01F 41/02* (2006.01)
(Continued)

(52) U.S. Cl.
CPC ..... *H01F 41/0226* (2013.01); *B22D 11/001* (2013.01); *B22D 11/0611* (2013.01);
(Continued)

(58) Field of Classification Search
None
See application file for complete search history.

(56) References Cited

U.S. PATENT DOCUMENTS 4,293,350 A 10/1981 Ichiyama et al.
4,613,842 A 9/1986 Ichiyama et al.
(Continued)

FOREIGN PATENT DOCUMENTS

CN 1270861 A 10/2000
JP 61-024208 A 2/1986
(Continued)

OTHER PUBLICATIONS

Communication dated Feb. 2, 2016 from the Japanese Patent Office issued in corresponding Application No. 2012-554865.
(Continued)

*Primary Examiner* — Xiaowei Su
(74) *Attorney, Agent, or Firm* — Sughrue Mion, PLLC

(57) ABSTRACT

A rapidly quenched Fe-based soft-magnetic alloy ribbon having wave-like undulations on a free surface, the wave-like undulations having transverse troughs arranged at substantially constant intervals in a longitudinal direction, and the troughs having an average amplitude D of 20 mm or less, is produced by a method comprising (a) keeping a transverse temperature distribution in a melt nozzle within ±15° C. to have as small a temperature distribution as possible in a melt paddle of the alloy, and (b) forming numerous fine linear scratches on a cooling roll surface by a wire brush, thereby providing a ground surface of the cooling roll with an arithmetical mean (average) roughness Ra of 0.1-1 μm and a maximum roughness depth Rmax of 0.5-10 μm.

9 Claims, 5 Drawing Sheets

(51) Int. Cl.

| | |
|---|---|
| ***B22D 11/00*** | (2006.01) |
| ***B22D 11/06*** | (2006.01) |
| ***C22C 38/00*** | (2006.01) |
| ***C22C 45/02*** | (2006.01) |
| ***H01F 27/25*** | (2006.01) |
| ***H01F 1/153*** | (2006.01) |
| ***B24B 5/37*** | (2006.01) |
| ***C21D 1/62*** | (2006.01) |
| ***C21D 9/573*** | (2006.01) |

(52) U.S. Cl.

CPC ..... *B22D 11/0614* (2013.01); *B22D 11/0642* (2013.01); *B22D 11/0668* (2013.01); *B22D 11/0682* (2013.01); *B22D 11/0697* (2013.01); *B24B 5/37* (2013.01); *C21D 1/62* (2013.01); *C21D 9/5737* (2013.01); *C22C 38/00* (2013.01); *C22C 45/02* (2013.01); *H01F 1/15333* (2013.01); *H01F 3/04* (2013.01); *H01F 27/25* (2013.01); *H01F 41/022* (2013.01); *C21D 2201/03* (2013.01)

(56) References Cited

U.S. PATENT DOCUMENTS

| | | | | |
|---|---|---|---|---|
| 4,685,980 | A * | 8/1987 | Sato | C21D 1/09 148/304 |
| 4,724,015 | A | 2/1988 | Sato et al. | |
| 4,869,312 | A * | 9/1989 | Liebermann | B22D 11/0611 164/463 |
| 5,301,742 | A | 4/1994 | Sato et al. | |
| 5,449,419 | A | 9/1995 | Suzuki et al. | |
| 5,456,308 | A | 10/1995 | Yukumoto et al. | |
| 6,425,960 | B1 | 7/2002 | Yoshizawa et al. | |
| 6,749,700 | B2 | 6/2004 | Sunakawa et al. | |
| 7,841,380 | B2 | 11/2010 | Numano et al. | |
| 2003/0041931 | A1 * | 3/2003 | Sunakawa | C22C 33/003 148/561 |
| 2006/0000524 | A1 | 1/2006 | Ogawa et al. | |
| 2008/0311423 | A1 | 12/2008 | Numano et al. | |
| 2009/0145526 | A1 | 6/2009 | Arai et al. | |
| 2009/0266448 | A1 | 10/2009 | Ohta et al. | |
| 2011/0033332 | A1 | 2/2011 | Numano et al. | |

FOREIGN PATENT DOCUMENTS

| | | | |
|---|---|---|---|
| JP | 62-049964 | B2 | 10/1987 |
| JP | 01-170554 | A | 7/1989 |
| JP | 3-032886 | B2 | 5/1991 |
| JP | 03-161149 | A | 7/1991 |
| JP | 04-279257 | A | 10/1991 |
| JP | 04-288950 | A | 10/1992 |
| JP | 6-292950 | A | 10/1994 |
| JP | 06-344091 | A | 12/1994 |
| JP | 7-276011 | A | 10/1995 |
| JP | 08-215799 | A | 8/1996 |
| JP | 08-215800 | A | 8/1996 |
| JP | 08-215801 | A | 8/1996 |
| JP | 10-064710 | A | 3/1998 |
| JP | 2001001113 | A | 1/2001 |
| JP | 2001-295005 | A | 10/2001 |
| JP | 2002-086249 | A | 3/2002 |
| JP | 2002-316243 | A | 10/2002 |
| JP | 2005-021950 | A | 1/2005 |
| JP | 2006-045662 | A | 2/2006 |
| JP | 2007-107095 | A | 4/2007 |
| WO | 2006/003899 | A1 | 1/2006 |

OTHER PUBLICATIONS

Communication dated Jun. 2, 2015, issued by the State Intellectual Property Office of the People's Republic of China in corresponding Chinese Application No. 201280006771.0.

Communication dated Sep. 20, 2016, from the Japanese Patent Office in counterpart Japanese application No. 2012-554865.

German Office Action dated Feb. 6, 2017, in corresponding Application No. 11 2012 000 399.3, 13 pages including translation.

International Search Report for PCT/JP2012/051808, dated May 1, 2012.

* cited by examiner

RAPIDLY QUENCHED FE-BASED SOFT-MAGNETIC ALLOY RIBBON AND ITS PRODUCTION METHOD AND CORE

CROSS REFERENCE TO RELATED APPLICATIONS

This application is a divisional of application Ser. No. 13/981,809 filed Jul. 25, 2013, which is a National Stage of International Application No. PCT/JP2012/051808 filed Jan. 27, 2012 (claiming priority based on Japanese Patent Application No. 2011-016017 filed Jan. 28, 2011), the contents of which are incorporated herein by reference in their entirety.

FIELD OF THE INVENTION

The present invention relates to a core having excellent magnetic properties for use in distribution transformers, reactors, choke coils, magnetic switches, etc., a quenched, Fe-based soft-magnetic alloy ribbon constituting such core, and its production method.

BACKGROUND OF THE INVENTION

As soft-magnetic materials used for cores for distribution transformers, etc., silicon steel, and ribbons of Fe-based amorphous alloys and Fe-based nanocrystalline alloys are known. Silicon steel is inexpensive and has a high magnetic flux density, but it suffers larger core loss than the Fe-based amorphous alloys. Though the Fe-based amorphous alloy ribbons produced by a rapid quenching method such as a single roll method have lower saturation magnetic flux densities than that of the silicon steel, they have lower core loss because they do not have magnetocrystalline anisotropy for the absence of crystals. Accordingly, they are used for cores for distribution transformers, etc. (for example, see JP 2006-45662 A).

Fe-based nanocrystalline alloy ribbons having nano-sized fine crystal grains, which are formed at high number densities in the alloys by heat-treating the Fe-based amorphous alloys produced by a rapid quenching method such as a single roll method, which may partially have crystal phases, have high saturation magnetic flux densities, as well as higher permeability, lower core loss and lower magnetostriction than those of the Fe-based amorphous alloy ribbons. Accordingly, they are mainly used for cores for choke coils, current sensors, etc. in electronic parts. Known as typical Fe-based nanocrystalline alloys are Fe—Cu—Nb—Si—B alloys, Fe—Zr—B alloys, etc. Fe-based nanocrystalline alloy ribbons having as high saturation magnetic flux density as about 1.8 T, which are suitable for distribution transformer cores, have recently been proposed (see JP 2007-107095 A).

The Fe-based amorphous alloy ribbons are usually produced by a rapid quenching method such as a single roll method, etc. The single roll method is a method for producing an alloy ribbon by ejecting an alloy melt from a nozzle onto a cooling roll made of a high-conductivity alloy, which is rotating at a high speed. The cooling roll is made of Cu alloys with good thermal conduction, such as Cu—Cr alloys, Cu—Ti alloys, Cu—Cr—Zr alloys, Cu—Ni—Si alloys, Cu—Be alloys, etc. To improve productivity, long, wide amorphous alloy ribbons are produced.

The Fe-based amorphous alloys such as Fe—Si—B alloys, etc. used for distribution transformers, etc. have small hysteresis loss because of small magnetic hysteresis. It is known, however, that the eddy current loss (core loss—hysteresis loss) of the Fe-based amorphous alloy in a broad sense is several tens to 100 times as large as the classical eddy current loss determined under the assumption of uniform magnetization. This increased loss is called anomalous eddy current loss or excess loss, which is generated mainly by uneven magnetization change due to large magnetic domain widths of the alloy. To reduce the anomalous eddy current loss, various methods of dividing magnetic domains finer have been attempted.

Known as methods of reducing the anomalous eddy current loss of the Fe-based amorphous alloy ribbon are a method of mechanically scratching a surface of the Fe-based amorphous alloy ribbon (JP 62-49964 B), a laser scribing method of irradiating a surface of the Fe-based amorphous alloy ribbon with laser beams for local melting and solidification by quenching to divide magnetic domains finer, etc. As the laser scribing method, for example, JP 3-32886 B discloses a method of irradiating an amorphous alloy ribbon with pulse laser beams in a transverse direction, thereby melting a surface of the amorphous alloy ribbon locally and instantaneously, and then solidifying it by quenching to form amorphized spots in lines, which divide magnetic domains finer. However, the laser scribing method has low productivity because of a small amount of treatments per a unit area.

JP 61-24208 A discloses a method of controlling the pitches and heights of wave-like undulations in desired ranges at the time of producing an amorphous alloy ribbon having wave-like undulations on a free surface by a single roll method, to divide magnetic domains finer, thereby reducing eddy current loss. This method has higher productivity than the laser scribing method, because the wave-like undulations are formed at the time of production of the amorphous alloy ribbon.

The formation of wave-like undulations on a free surface of an amorphous alloy ribbon produced by a single roll method appears to be due to the vibration of a melt paddle on a cooling roll. However, transverse troughs constituting the wave-like undulations are usually not straight but meandering like waves. Troughs reduce eddy current loss by the division of magnetic domains, but the meandering of transverse troughs increases hysteresis loss. Increased hysteresis loss is serious particularly in wide amorphous alloy ribbons. It is thus desired to provide amorphous alloy ribbons, in which the meandering of transverse troughs constituting the wave-like undulations is as small as possible.

With respect to the suppression of the vibration of a melt paddle, JP 2002-316243 A discloses a method for producing an amorphous alloy ribbon by quenching an alloy melt on a cooling roll, a $CO_2$ gas being blown onto the alloy melt, while the cooling roll is ground. To grind the cooling roll, a brush of brass or stainless steel wires of 0.06 mm in diameter, etc. are used. JP 2002-316243 A describes that if a brush used for grinding were too hard, a ground surface of the cooling roll would have too deep scratches, resulting in cutting of the amorphous alloy ribbons, and little effect of improving surface roughness, and that therefor the brush hardness is preferably equal to or less than the hardness of the cooling roll. However, amorphous alloy ribbons obtained by the method described in JP 2002-316243 A have large core loss despite wave-like undulations on free surfaces.

OBJECT OF THE INVENTION

Accordingly, an object of the present invention is to provide a quenched, Fe-based soft-magnetic alloy ribbon with reduced core loss, a core formed thereby, and a method for producing such quenched, Fe-based soft-magnetic alloy ribbon.

SUMMARY OF THE INVENTION

As a result of intensive research in view of the above object, it has been found that (a) a large core loss of the amorphous alloy ribbon obtained by the method described in JP 2002-316243 A is due to large hysteresis loss; that (b) the hysteresis loss depends on the meandering level of transverse troughs constituting the wave-like undulations; that (c) the vibration of the melt paddle should be reduced to suppress the transverse troughs; that (d) the suppression of the vibration of a melt paddle is not sufficiently achieved by merely grinding a surface of a cooling roll by a brush; and that (e) a combination of fine linear scratches formed on a surface of a cooling roll ground by a brush and a desired temperature distribution range in a nozzle ejecting an alloy melt can suppress the vibration of a melt paddle, thereby suppressing the meandering of the transverse troughs. It has also been found that the depths of linear scratches formed on a ground surface of a cooling roll are determined not only by the hardness of a brush, but also by the pressure of a brush onto a cooling roll, the number and direction of rotation of a brush, the number of wires in a brush coming into contact with a unit area of a cooling roll, etc. Particularly in the production of amorphous alloy ribbons for a long period of time, a cooling roll surface is roughened by oxides attached, etc., needing the grinding of a cooling roll surface. In such case, it has been found that forming fine linear scratches with desired roughness instead of grinding a roll to have a mirror surface is necessary to suppress the vibration of the melt paddle effectively.

As a result, the inventors have found that when an alloy melt is ejected onto a rotating cooling roll, (a) while keeping a transverse temperature distribution in a melt nozzle within ±15° C. to provide a melt paddle with as small a temperature distribution as possible, and (b) while grinding a cooling roll surface by a wire brush to form fine linear scratches having an average roughness Ra of 0.1-1 μm and a maximum roughness depth Rmax of 0.5-10 μm, a quenched, Fe-based soft-magnetic alloy ribbon having wave-like undulations on a free surface is formed, transverse troughs in the wave-like undulations having reduced meandering. The present invention has been completed based on such findings.

Thus, the quenched, Fe-based soft-magnetic alloy ribbon of the present invention has wave-like undulations on a free surface, the wave-like undulations having transverse troughs arranged at substantially constant intervals in a longitudinal direction, and the troughs having an average amplitude D of 20 mm or less.

Ridges extending in a transverse direction are preferably formed in regions longitudinally adjacent to the troughs.

Regions having the troughs preferably occupy 70% or more of the width of the ribbon with the longitudinal centerline of the ribbon as a center. It is more preferable that the troughs continuously extend fully between both side ends of the ribbon.

The troughs preferably have longitudinal intervals L in a range of 1-5 mm. The ribbon preferably has a thickness T in a range of 15-35 μm. A ratio t/T of an average height difference t between the troughs and the ridges to the thickness of the ribbon is preferably in a range of 0.02-0.2.

The quenched, Fe-based soft-magnetic alloy ribbon is preferably formed by an Fe-based amorphous alloy or an Fe-based fine-crystalline alloy partially having crystal phases.

The method of the present invention for producing a quenched, Fe-based soft-magnetic alloy ribbon having wave-like undulations on a free surface, the wave-like undulations having transverse troughs arranged at substantially constant intervals in a longitudinal direction, and the troughs having an average amplitude D of 20 mm or less, comprises the steps of (a) keeping a transverse temperature distribution in a melt nozzle within ±15° C. to have as small a temperature distribution as possible in a melt paddle of the alloy; and (b) forming numerous fine linear scratches on a cooling roll surface by a wire brush, thereby providing a ground surface of the cooling roll with an average roughness Ra of 0.1-1 μm and a maximum roughness depth Rmax of 0.5-10 μm.

In the above method, it is preferable to use a heating nozzle having a slit-shaped opening for blowing a heating gas onto the melt nozzle, the length of the slit-shaped opening of the heating nozzle being 1.2-2 times the horizontal length of a slit-shaped orifice of the melt nozzle.

The core of the present invention is formed by laminating or winding the above quenched, Fe-based soft-magnetic alloy ribbon.

The core of the present invention is preferably heat-treated in a magnetic field in a magnetic path direction.

BRIEF DESCRIPTION OF THE DRAWINGS

FIG. 3(*b*) is a schematic view showing another example of apparatuses for producing the quenched, Fe-based soft-magnetic alloy ribbon of the present invention FIG. 4(*a*) is a partial cross-sectional view showing in detail a melt nozzle and its vicinity in the apparatus of FIG. 3(*a*).

DESCRIPTION OF THE PREFERRED EMBODIMENTS

[1] Principle

When an Fe-based soft-magnetic alloy ribbon made of an Fe-based amorphous alloy or an Fe-based fine-crystalline alloy partially having crystal phases is produced by a single roll method, a melt paddle formed between a melt nozzle and a cooling roll is inevitably vibrated. The vibration of the melt paddle is affected by the viscosity and surface tension of the melt paddle, the temperature distribution of a melt nozzle, the surface conditions of a cooling roll, etc. The temperature distribution of the melt nozzle would cause the local deformation of the melt nozzle, the thickness-direction variations of a gap between the melt nozzle and the cooling roll, etc. The temperature distribution of the melt paddle would cause oxides, etc. to attach to a portion of the cooling roll surface in contact with a low-temperature portion of the melt paddle, resulting in larger melt paddle vibration. The vibration of the melt paddle increases as a wider Fe-based soft-magnetic alloy ribbon is produced, specifically remarkable in the case of an Fe-based soft-magnetic alloy ribbon as wide as 20 mm or more, particularly 50 mm or more. This appears to be due to the fact that a wider Fe-based soft-magnetic alloy ribbon is more affected by the temperature distribution of the melt paddle.

Larger vibration of the melt paddle provides a free surface of the Fe-based soft-magnetic alloy ribbon with larger wave-like undulations, resulting in larger transverse-direction disturbance of individual troughs constituting the wave-like undulations. The transverse-direction disturbance of troughs hinders the movement of magnetic domain walls, resulting in increased hysteresis loss.

As a result of intensive research to solve this problem, it has been found that though heating a melt nozzle at a constant temperature is effective to prevent the vibration of the melt paddle, it is likely to cause the attachment of oxides, etc., which causes the vibration of the melt paddle. Further investigation has revealed that the vibration of the melt paddle can be effectively reduced by making the temperature variations of the melt nozzle as small as possible in a transverse direction, and by grinding the cooling roll surface with a wire brush to form numerous fine linear scratches. This is completely contradictory to a conventional idea that a cooling roll had better have as mirror-finished a surface as possible. Thus, the present invention is based on the discovery that the formation of fine linear scratches on the cooling roll surface reduces the temperature distribution of the melt nozzle, thereby increasing an effect of suppressing the vibration of the melt paddle.

[2] Quenched, Fe-Based Soft-Magnetic Alloy Ribbon

Figure 1:
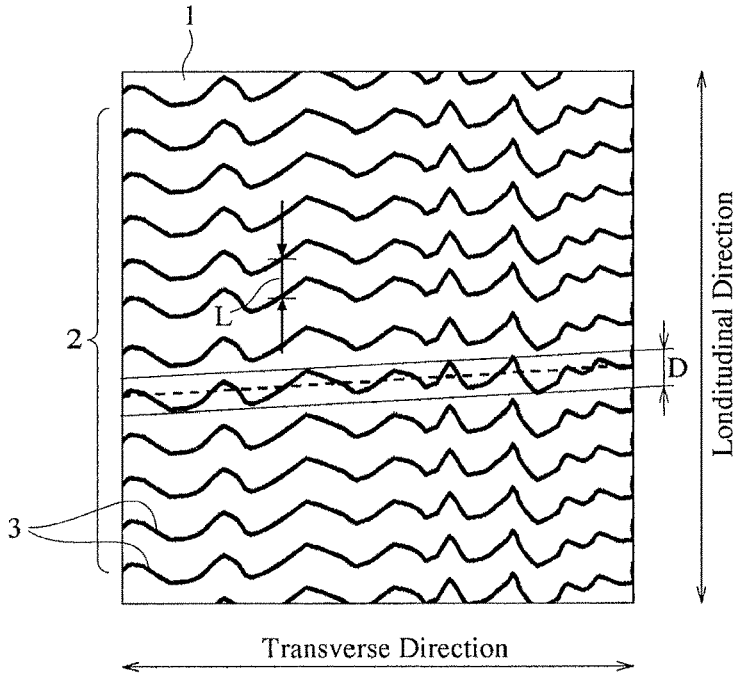
FIG. 1 is a plan view schematically showing wave-like undulations formed on a free surface of the quenched, Fe-based soft-magnetic alloy ribbon.

FIG. 1 schematically shows wave-like undulations 2 on a free surface of the quenched, Fe-based soft-magnetic alloy ribbon 1. Because troughs 3 constituting the wave-like undulations 2 contribute to the reduction of eddy current loss by making magnetic domains smaller, the wave-like undulations 2 are preferably formed on the ribbon 1 in entire transverse ranges, though a sufficient effect of reducing eddy current loss can be obtained as long as the wave-like undulations 2 occupy 70% or more of the width of the ribbon 1 with a longitudinal centerline as a center. The transverse-direction occupancy ratio of the wave-like undulations 2 is preferably 80% or more, most preferably 100%. The troughs 3 may not be continuous in a transverse direction, as long as the transverse-direction occupancy ratio of the wave-like undulations 2 is 70% or more as a whole. The transverse-direction occupancy ratio of the wave-like undulations 2 is determined by selecting five arbitrary regions of 50 mm long on the ribbon 1 in a longitudinal direction, and averaging transverse-direction occupancy ratios measured in these regions.

As shown in FIG. 1, the troughs 3 extending in a transverse direction are curved like waves. Larger disturbances (larger wave amplitudes) of the troughs 3 hinder the movement of magnetic domain walls during magnetization, resulting in larger hysteresis loss. Accordingly, the troughs 3 should have as small disturbances (wave amplitudes) as possible in a transverse direction. The transverse-direction disturbance of the troughs 3 can be expressed by an average amplitude D. The average amplitude D is determined by selecting five arbitrary regions of 50 mm long, calculating an average amplitude of the troughs 3 in each region, and averaging them in five regions. When the troughs 3 are inclined to a transverse direction, the average amplitude D is measured in parallel with the longitudinal direction of the ribbon 1.

When the average amplitude D representing the transverse-direction disturbance of the troughs 3 is 20 mm or less, eddy current loss is reduced with hysteresis loss suppressed. The average amplitude D of more than 20 mm provides increased hysteresis loss. This appears to be due to the fact that magnetic energy changes near the troughs 3, but increase in the transverse-direction disturbance of troughs 3 results in larger transverse-direction variations of magnetic energy, so that magnetic domain walls are likely trapped at positions having low magnetic energy, hindering smooth movement of magnetic domain walls. Further, the transverse-direction disturbance of troughs 3 tends to increase the percentage of magnetic domains having magnetization directions not in parallel with the longitudinal direction of the ribbon 1, thereby increasing exciting power. Thus, because the average amplitude D of more than 20 mm increases hysteresis loss and exciting power, the average amplitude D of the troughs 3 should be 20 mm or less. The average amplitude D of the troughs 3 is preferably 5 mm or less, more preferably 0.1-2 mm.

Figure 2:
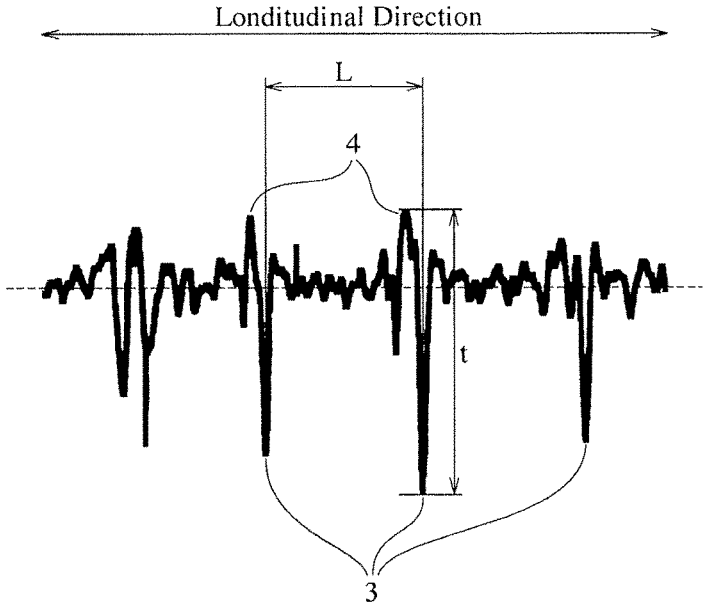
FIG. 2 is a view showing a longitudinal profile of wave-like undulations formed on a free surface of the quenched, Fe-based soft-magnetic alloy ribbon.

As shown in FIG. 2, the troughs 3 constituting the wave-like undulations 2 are aligned in a longitudinal direction at substantially constant intervals. The longitudinal intervals L of the troughs 3 are preferably in a range of 1-5 mm. When the longitudinal intervals L of the troughs 3 are less than 1 mm, there is large apparent power. On the other hand, the longitudinal intervals L exceeding 5 mm result in a small effect of reducing eddy current loss. To obtain a large effect of reducing eddy current loss, the longitudinal intervals L of the troughs 3 are more preferably 1.5-3 mm.

There are ridges 4 in regions longitudinally adjacent to the troughs 3. To obtain a sufficient effect of reducing eddy current loss, an average height difference t between troughs 3 and ridges 4 is preferably 0.3-7 μm, more preferably 1-4 μm. The average height difference t is determined by selecting five arbitrary regions of 50 mm long in a longitudinal direction, calculating an average height difference between troughs 3 and ridges 4 in each region, and averaging them in five regions. The thickness T of the ribbon 1 is preferably in a range of 15-35 μm. A ratio t/T of the average height difference t between troughs 3 and ridges 4 to the thickness T of the ribbon 1 is preferably in a range of 0.02-0.2. The ratio t/T of less than 0.02 provides a small effect of reducing eddy current loss, and the ratio t/T of more than 0.2 increases the apparent power, and reduces the space factor of a core. The more preferred range of t/T is 0.04-0.15.

The Fe-based amorphous alloys include Fe—B alloys, Fe—Si—B alloys, Fe—Si—B—C alloys, Fe—Si—B—P alloys, Fe—Si—B—C—P alloys, Fe—P—B alloys, Fe—P—C alloys, etc., and among them, the Fe—Si—B alloys are suitable from the aspect of thermal stability and easiness of production. The Fe-based amorphous, soft-magnetic alloy ribbon may contain Co, Ni, Mn, Cr, V, Mo, Nb, Ta, Hf, Zr, Ti, Cu, Au, Ag, Sn, Ge, Re, Ru, Zn, In, Ga, etc., if necessary.

One example of the Fe-based amorphous alloys has a composition represented by $Fe_{100-a-b-c}M_aSi_bB_c$ (atomic %), wherein M is at least one element selected from the group consisting of Cr, Mn, Ti, V, Zr, Nb, Mo, Hf, Ta, W and Sn, $0 \le a \le 10$, $0 \le b \le 20$, $4 \le c \le 20$, and $10 \le a+b+c \le 35$. M has an effect of accelerating amorphization. To control the induced magnetic anisotropy, less than 50 atomic % of Fe may be substituted by Co and/or Ni. Co has an effect of improving the saturation magnetic flux density. Also, 50% by mass or less of M may be substituted by at least one element selected from the group consisting of Zn, As, Se, Sb, In, Cd, Ag, Bi, Mg, Sc, Re, Au, platinum-group elements, Y and rare earth elements. Further, to improve corrosion resistance and thermal stability, 50 atomic % or less of the total amount of Si and B may be substituted by at least one element selected from the group consisting of C, Al, P, Ga and Ge.

The Fe-based fine-crystalline alloys partially having crystal phases include Fe—Cu—Si—B alloys, Fe—Cu—Si—B—C alloys, Fe—Cu—Si—B—P alloys, Fe—Cu—Si—B—C—P alloys, Fe—Cu—P—B alloys, Fe—Cu—P—C alloys, etc. The Fe-based fine-crystalline alloys may contain Co, Ni, Mn, Cr, V, Mo, Nb, Ta, Hf, Zr, Ti, Au, Ag, Sn, Ge, Re, Ru, Zn, In, Ga, etc., if necessary.

One example of the Fe-based fine-crystalline alloys has a composition represented by $Fe_{100-a-b-c-d}M_aSi_bB_cCu_d$ (atomic %), wherein M is at least one element selected from the group consisting of Ti, V, Zr, Nb, Mo, Hf, Ta and W, $0 \le a \le 10$, $0 \le b \le 20$, $4 \le c \le 20$, $0.1 \le d \le 3$, and $10 \le a+b+c+d \le 35$. M has an effect of performing amorphization and making finer crystal grains generated by a heat treatment. To control the induced magnetic anisotropy, less than 50 atomic % of Fe may be substituted by Co and/or Ni. Co has an effect of improving the saturation magnetic flux density. Also, 50 atomic % or less of M may be substituted by at least one element selected from the group consisting of Cr, Mn, Zn, As, Se, Sb, Sn, In, Cd, Ag, Bi, Mg, Sc, Re, Au, platinum-group elements, Y and rare earth elements. Further, to adjust the magnetostriction and magnetic properties of nanocrystalline alloys, 50 atomic % or less of the total amount of Si and B may be substituted by at least one element selected from the group consisting of C, Al, P, Ga and Ge.

[3] Production Method

Figure 3A:
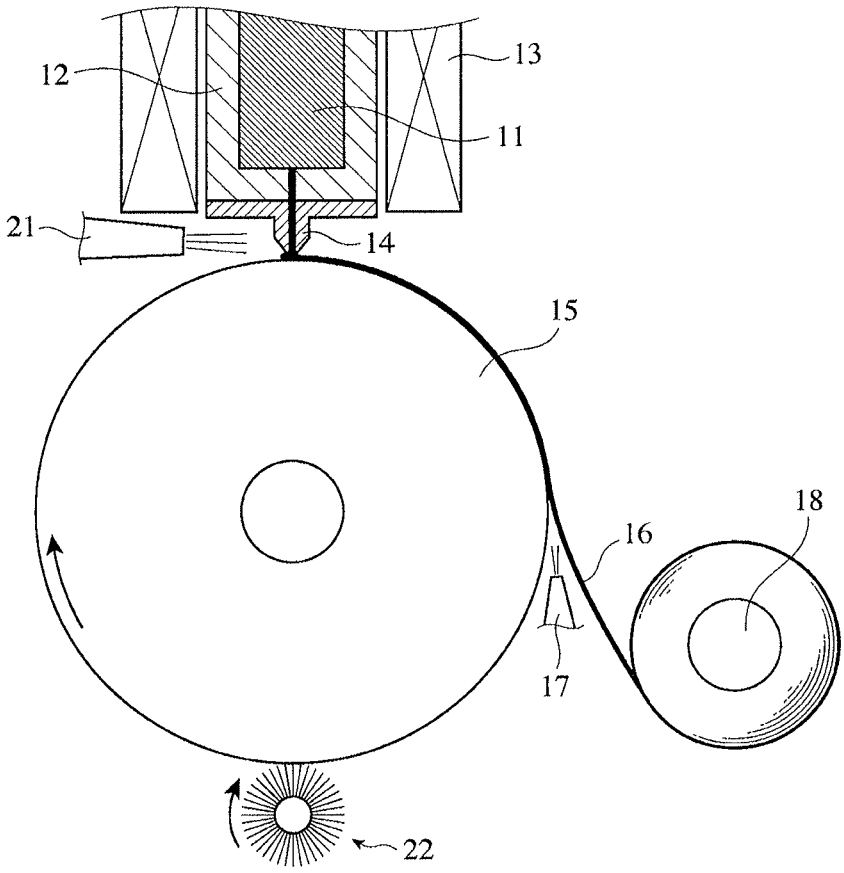
FIG. 3(*a*) is a schematic view showing one example of apparatuses for producing the quenched, Fe-based soft-magnetic alloy ribbon of the present invention.
Figure 3B:
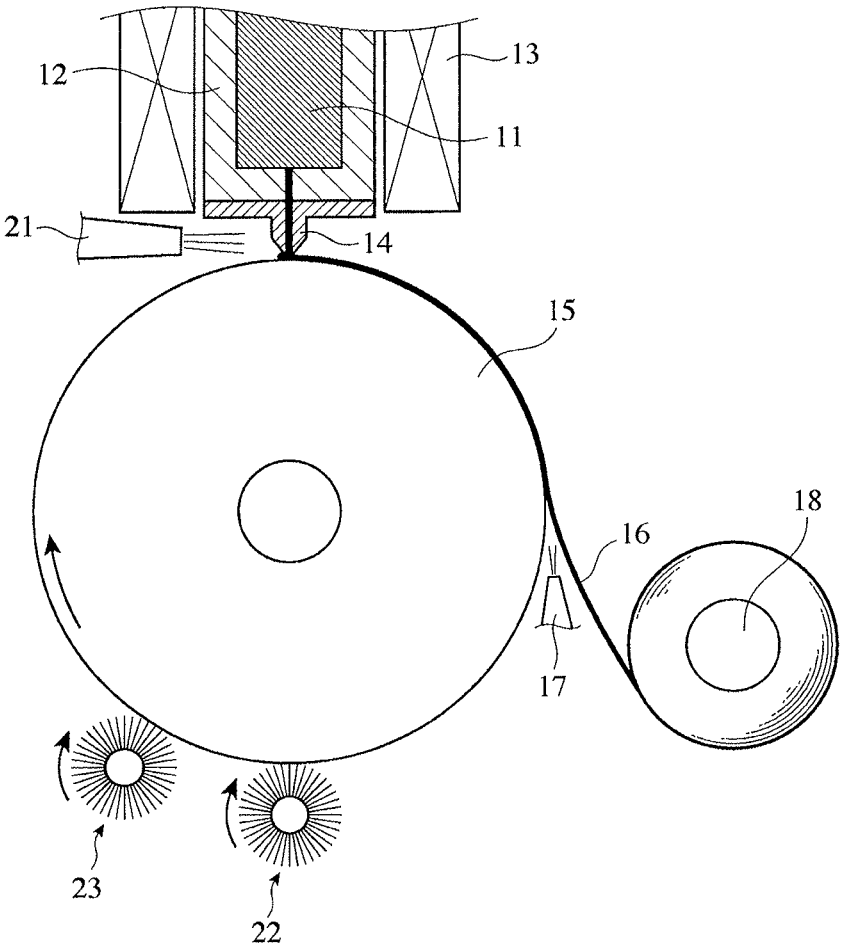

FIG. 3(*a*) shows one example of apparatuses for producing the quenched, Fe-based soft-magnetic alloy ribbon of the present invention. This apparatus comprises a crucible 12 for containing an Fe-based alloy melt 11, a high-frequency coil 13 arranged around the crucible 12 for heating the melt 11, a melt nozzle 14 disposed at the bottom of the crucible 12 for ejecting the melt 11 onto a cooling roll 15, a peeling nozzle 17 for ejecting a gas for peeling an Fe-based amorphous alloy ribbon formed by quenching on the cooling roll 15, a reel 18 for winding the Fe-based amorphous alloy ribbon 16, a heating nozzle 21 for ejecting a heating gas for keeping the temperature of the melt nozzle 14 constant, and a wire brush roll 22 disposed in contact with the cooling roll 15 upstream of the melt paddle 11*a* in a rotation direction. The melt nozzle 14 has a slit-shaped orifice for ejecting the melt 11.

Figure 4A:
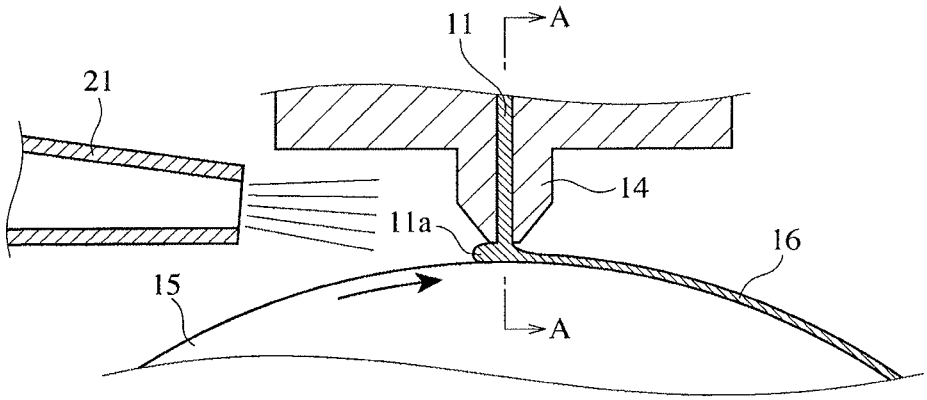
FIG. 4(*b*) is a cross-sectional view taken along the line A-A in FIG. 3(*a*).
Figure 4B:
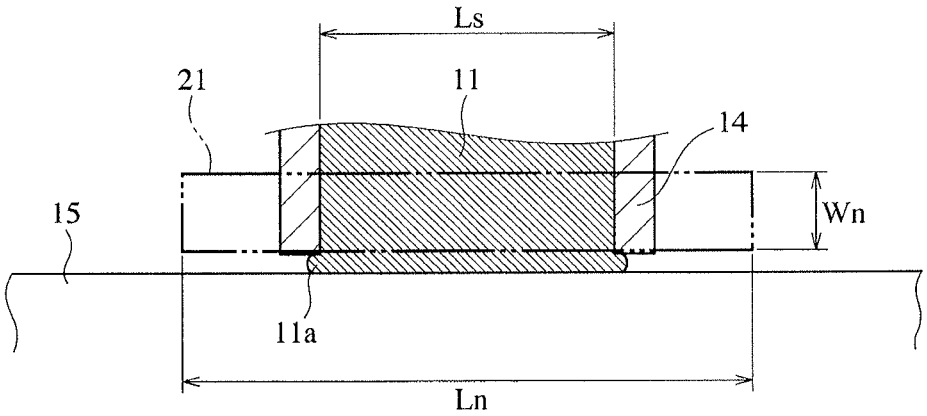

As shown in FIGS. 4(*a*) and 4(*b*), the heating nozzle 21 arranged near the melt paddle 11*a* and the melt nozzle 14 has a slit-shaped orifice opening having a width Wn sufficiently covering the melt nozzle 14, and a length Ln sufficiently exceeding the horizontal length Ls of the slit-shaped orifice of the melt nozzle 14. Specifically, the length Ln of the slit-shaped opening of the heating nozzle 21 is preferably 1.2-2 times as large as Ls. To make the temperature distribution of the melt paddle 11*a* as small as possible, the temperature distribution of the melt nozzle 14 in a transverse direction should be kept within ±15° C. For this purpose, the temperature of a heating gas ejected from the heating nozzle 21 is preferably 800-1400° C., more preferably 1000-1200° C. The heating gas is preferably an inert gas such as a carbon dioxide gas, an argon gas, etc.

The wire brush roll 22 grinding a surface of the cooling roll 15 preferably comprises harder metal wires than the cooling roll 15 to form numerous fine linear scratches on the ground surface of the cooling roll 15. Such metal wires are preferably stainless steel wires. The diameters of stainless steel wires are preferably about 0.02-0.1 mm.

The roughness of fine linear scratches formed on the surface of the cooling roll 15 by grinding with the wire brush roll 22 is expressed by arithmetical mean (average) roughness (average roughness) Ra and maximum roughness depth Rmax. The arithmetical mean (average) roughness (average roughness) Ra and maximum roughness depth Rmax depend not only on the hardness and diameters of metal wires, but also on the pushing force (pressure) of the wire brush roll 22 to the cooling roll 15, the number and direction of rotation of the wire brush roll 22, the number of metal wires coming into contact with a unit area of the cooling roll 15, etc. With these conditions adjusted, the ground surface of the cooling roll 15 has an average roughness Ra of 0.1-1 μm and a maximum roughness depth Rmax of 0.5-10 μm. The average roughness Ra of less than 0.1 μm does not provide a sufficient effect of suppressing the vibration of the melt paddle 11*a*, and Ra of more than 1 μm provides the surface of the cooling roll 15 with too large linear scratches, resulting in a rapidly quenched, Fe-based soft-magnetic alloy ribbon with reduced magnetic properties. Likewise, the maximum roughness depth Rmax of less than 0.5 μm does not provide a sufficient effect of suppressing the vibration of the melt paddle 11*a*, and Rmax of more than 10 μm provides too large linear scratches on the surface of the cooling roll 15, resulting in a rapidly quenched, Fe-based soft-magnetic alloy ribbon with reduced magnetic properties. The preferred average roughness Ra is 0.2-0.8 μm, and the preferred maximum roughness depth Rmax is 1-5 μm.

The number of wire brush rolls 22 for forming fine linear scratches having the above average roughness Ra and maximum roughness depth Rmax is not restricted to one, but two or more wire brush rolls may be arranged in a rotation direction. As shown in FIG. 3(*b*), a grinding roll 23 for removing burrs may be placed downstream of the wire brush roll 22 in a rotation direction. As the grinding roll 23, for example, a buffing brush roll of chemical fibers containing grinding particles such as diamond particles, etc. may be used.

It is not necessarily clear why the cooling roll 15 having a ground surface having the above fine linear scratches more suppresses the vibration of the melt paddle 11*a* than that having a mirror surface. It is considered that a mirror-finished surface of the cooling roll 15 is not necessarily free from defects such as scratches, etc. at all, and that even the slightest defects in part of the mirror surface have large influence, unstabilizing the melt paddle 11*a* to cause vibration. On the other hand, the formation of fine linear scratches on the entire ground surface of the cooling roll 15 provides uniformity as a whole despite local unevenness, alleviating the influence of partial defects if any. As a result, the melt paddle 11*a* is stabilized.

A proper effect of suppressing the vibration of the melt paddle 11*a* by fine linear scratches on the surface of the cooling roll 15 would not be obtained unless the temperature of the nozzle 14 is kept constant to provide the melt paddle 11*a* with as small temperature distribution as possible. In other words, a sufficient effect of suppressing the vibration of the melt paddle 11*a* cannot be obtained by merely forming fine linear scratches on the surface of the cooling roll 15, or by merely keeping the temperature of the melt nozzle 14 constant. Only a combination of both means can provide a proper effect of suppressing the vibration of the melt paddle 11*a*. Because the vibration of the melt paddle 11*a* would occur even by slight variations of conditions, it is not easy to find a means for suppressing it. By a combination of fine linear scratches formed on the surface of the cooling roll 15 and the reduced temperature distribution of the melt nozzle 14, the present invention has succeeded in meeting both difficult requirements of reducing eddy current loss by the wave-like undulations acting to make magnetic domains smaller, and preventing increase in hysteresis loss by suppressing the amplitude of transverse troughs in the wave-like undulations.

Figure 5:
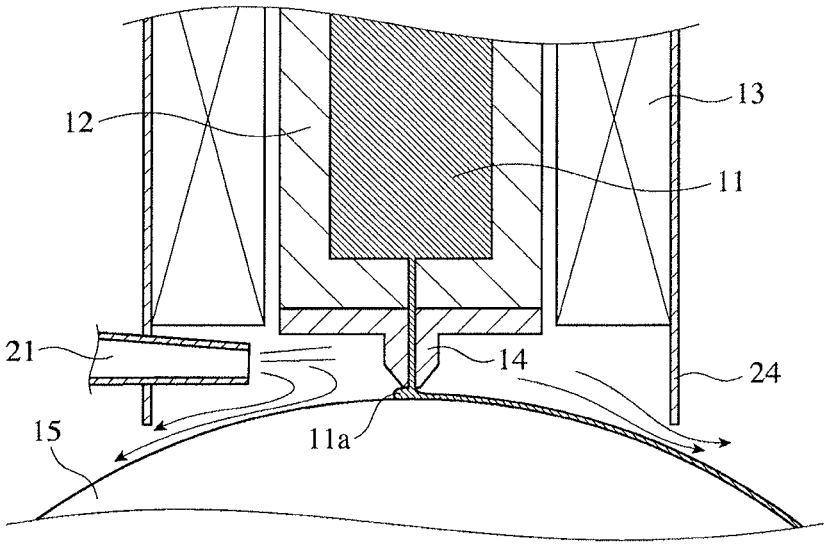
FIG. 5 is a partial cross-sectional view showing in detail another main portion of the apparatus for producing the quenched, Fe-based soft-magnetic alloy ribbon of the present invention.

FIG. 5 shows an example comprising a hood 24 for keeping the temperature of the melt nozzle 14 constant. The heating nozzle 21 is fixed to the hood 24, such that its slit-shaped opening is positioned in the hood 24. Because a heating gas ejected from the slit-shaped opening of the heating nozzle 21 flows between the hood 24 and the cooling roll 15, the temperature distribution of the melt nozzle 14 can be surely reduced.

The resultant Fe-based soft-magnetic alloy ribbon may be heat-treated. The heat treatment is preferably conducted at a temperature of 350-650° C. in an inert gas such as Ar, nitrogen, etc. The heat treatment time is usually 24 hours or less, preferably 5 minutes to 4 hours. The rapidly quenched Fe-based soft-magnetic alloy ribbon of the present invention may be coated with $SiO_2$, MgO, $Al_2O_3$, etc., or subject to such treatments as a chemical conversion treatment, an anodic oxidation treatment, etc., if necessary, to increase its insulation.

[4] Core

The core of the present invention is formed by laminating or winding the quenched, Fe-based soft-magnetic alloy ribbon. Because the quenched, Fe-based soft-magnetic alloy ribbon of the present invention has eddy current loss and hysteresis loss both reduced, a core formed thereby has low core loss. The core is heat-treated in an inert gas such as a nitrogen gas, Ar, etc., in vacuum, or in the air. With a magnetic field applied in a magnetic path direction of the core during the heat treatment, the resultant core has a high squareness ratio, high apparent power, and low core loss. To obtain a high squareness ratio, a magnetic field having such intensity as to magnetically saturate the core is applied. The intensity of the magnetic field is preferably 400 A/m or more, more preferably 800 A/m or more. The magnetic field applied is mostly a DC magnetic field, but an AC magnetic field may be used. The heat treatment may be carried out by a single step or by multiple steps.

The present invention will be explained in further detail by Examples below, without intention of restricting the present invention thereto.

Example 1

In the apparatus shown in FIG. 3(*a*), a ceramic-made nozzle 14 having a slit-shaped opening of 50 mm in length and 0.6 mm in width was used, with the gap between a tip end of the melt nozzle 14 and a cooling roll 15 being 250 μm. The water-cooling roll 15 made of a Cu—Cr—Zr alloy was rotated at a peripheral speed of 25.5 m/s. While ejecting a carbon dioxide gas at 1250° C. from a heating nozzle 21, an alloy melt at 1300° C., which comprised 11.5 atomic % of B, 9.5 atomic % of Si and 0.3 atomic % of C, the balance being substantially Fe and inevitable impurities, was ejected from the melt nozzle 14 onto the rotating water-cooling roll 15, to produce an Fe-based amorphous alloy ribbon of 50 mm in width and 24.3 μm in average thickness. During the production of the Fe-based amorphous alloy ribbon, the transverse temperature distribution of the melt nozzle 14 was 1200° C.±10° C., extremely uniform.

During the production of the Fe-based amorphous alloy ribbon, a wire brush roll 11 of stainless steel wires of 0.06 mm in diameter was rotated at a peripheral speed of 3 m/s in an opposite direction to the cooling roll 15. Fine linear scratches having an arithmetical mean (average) roughness Ra of 0.6 μm and a maximum roughness depth Rmax of 4.7 μm were formed on a surface of the cooling roll 15 ground by the wire brush roll 11. As a result, the attachment of oxides to the cooling roll 15 was suppressed.

The resultant Fe-based amorphous alloy ribbon exhibited a halo pattern peculiar to the amorphous structure in X-ray diffraction. Wave-like undulations 2 formed on a free surface of the Fe-based amorphous alloy ribbon had continuous troughs 3 in a range of 80% of the ribbon width, the troughs 3 having an average amplitude D of 8.2 mm and an average longitudinal interval L of 2.0 mm, and the average height difference t between the troughs 3 and the ridges 4 being 3.0 μm or less.

Comparative Example 1

An Fe-based amorphous alloy ribbon was produced under the same conditions as in Example 1, except that a heated carbon dioxide gas was not ejected from a heating nozzle 21. This Fe-based amorphous alloy ribbon exhibited a halo pattern in X-ray diffraction, and wave-like undulations 2 formed on its free surface had continuous troughs 3 in a range of 80% of the ribbon width. Though the wave-like undulations 2 had substantially the same average longitudinal interval L and average height difference t between troughs 3 and ridges 4 as those of Example 1, the average amplitude D of the troughs 3 was as extremely large as 24.0 mm.

Comparative Example 2

An Fe-based amorphous alloy ribbon was produced under the same conditions as in Example 1, except for using no wire brush roll 11. This Fe-based amorphous alloy ribbon exhibited a halo pattern in X-ray diffraction, and wave-like undulations 2 formed on its free surface had continuous troughs 3 in a range of 80% of the ribbon width. Because oxides were attached to the cooling roll 15 during production for a long period of time, extremely large wave-like undulations 2 were formed on a free surface of the Fe-based amorphous alloy ribbon, their average longitudinal interval L being 2.1 mm, the average height difference t between troughs 3 and ridges 4 being 7.3 μm, and the average amplitude D of the troughs 3 being 26.4 mm.

The Fe-based amorphous alloy ribbons of Example 1 and Comparative Examples 1 and 2 were heat-treated at 350° C. for 60 minutes in a longitudinal magnetic field of 1500 A/m. A single sheet sample of each heat-treated, Fe-based amorphous alloy ribbon was measured with respect to a DC B-H loop, to determine hysteresis loss $Ph_{1.3/50}$ at 1.3 T and 50 Hz. Further, the core loss $P_{1.3/50}$ and exciting power $S_{1.3/50}$ of the single sheet sample were measured at 1.3 T and 50 Hz by a single sheet tester (apparatus for evaluating the magnetic properties of a single sheet). The results are shown in Table 1.

TABLE 1

| No. | D (mm) | L (mm) | T (μm) | t/T | $P_{h1.3/50}$ (W/kg) | $P_{1.3/50}$ (W/kg) | $S_{1.3/50}$ (VA/kg) |
|---|---|---|---|---|---|---|---|
| Example 1 | 8.2 | 2.0 | 23.5 | 0.08 | 0.033 | 0.053 | 0.070 |
| Com. Ex. 1 | 24.0 | 2.0 | 23.6 | 0.08 | 0.049 | 0.093 | 0.090 |
| Com. Ex. 2 | 26.4 | 2.1 | 23.5 | 0.31 | 0.059 | 0.113 | 0.120 |

As is clear from Table 1, the Fe-based amorphous alloy ribbon of Example 1 having smaller wave-like undulations 2, in which the average amplitude D of the troughs 3 was as small as 8.2 mm, had hysteresis loss $Ph_{1.3/50}$ of 0.033 W/kg, core loss $P_{1.3/50}$ of 0.053 W/kg, and exciting power $S_{1.3/50}$ of 0.070 VA/kg, smaller than those of the Fe-based amorphous alloy ribbons of Comparative Examples 1 and 2.

Examples 2-19

A ceramic-made nozzle 14 having a slit-shaped opening of 30 mm in length and 0.5-0.7 mm in width was used in the apparatus shown in FIG. 3(*a*), with a gap of 150-300 μm between a tip end of the nozzle 14 and a cooling roll 15. The water-cooling roll 15 made of a Cu—Be alloy was rotated at a peripheral speed of 20-35 m/s. While ejecting a carbon dioxide gas at 1190° C. from the heating nozzle 21, each alloy melt having the composition (atomic %) shown in Table 2 at 1250-1350° C. was ejected from the melt nozzle 14 onto the rotating water-cooling roll 15, to produce an Fe-based amorphous alloy ribbon of 30 mm in width. During the production of the Fe-based amorphous alloy ribbon, a transverse temperature distribution in the nozzle 14 was as extremely uniform as 1200° C.±10° C.

During the production of the Fe-based amorphous alloy ribbon, a wire brush roll 11 having stainless steel wires of 0.03 mm in diameter was rotated at a peripheral speed of 4 m/s in an opposite direction to the cooling roll 15. A surface of the cooling roll 15 ground by the wire brush roll 11 had fine linear scratches having an average roughness Ra of 0.25 μm and maximum roughness depth Rmax of 2.7 μm. As a result, the attachment of oxides to the cooling roll 15 was suppressed.

Comparative Examples 3-6

Each Fe-based amorphous alloy ribbon was produced under the same conditions as in Examples 2-19, except that a heated carbon dioxide gas was not ejected from a heating nozzle 21. During the production of the Fe-based amorphous alloy ribbon, a transverse temperature distribution in the melt nozzle 14 was as large as 1200° C.±30° C.

During the production of the Fe-based amorphous alloy ribbon, a wire brush roll 11 having stainless steel wires of 0.05 mm in diameter was rotated at a peripheral speed of 5 m/s in an opposite direction to the cooling roll 15. A surface of the cooling roll 15 ground by the wire brush roll 11 had fine linear scratches having an average roughness Ra of 0.4 μm and maximum roughness depth Rmax of 2.3 μm. As a result, the attachment of oxides to the cooling roll 15 was suppressed.

Any of the Fe-based amorphous alloy ribbons produced in Examples 2-19 and Comparative Examples 3-6 exhibited a halo pattern peculiar to the amorphous structure in X-ray diffraction. Each Fe-based amorphous alloy ribbon had the thickness T shown in Table 2. Wave-like undulations 2 formed on a free surface of each Fe-based amorphous alloy ribbon had continuous troughs 3 in a range corresponding to 100% of the ribbon width, and the troughs shown in Table 2 had an average amplitude D of 8.9 mm, an average longitudinal interval L of 2.5 mm, and an average t/T ratio of 0.1.

TABLE 2

| No. | Composition (atomic %) | D (mm) | L (mm) | T (μm) | t/T |
|---|---|---|---|---|---|
| Example 2 | $Fe_{bal.}B_{13}Si_9$ | 8.2 | 2.1 | 23.2 | 0.09 |
| Example 3 | $Fe_{bal.}B_{12}Si_{9.7}C_{0.4}$ | 7.6 | 2.4 | 23.6 | 0.08 |
| Example 4 | $Fe_{bal.}B_{11}Si_9C_{0.2}$ | 11.6 | 1.9 | 24.8 | 0.05 |
| Example 5 | $Fe_{bal.}B_{11}Si_9$ | 7.0 | 2.0 | 24.1 | 0.11 |
| Example 6 | $Fe_{bal.}B_{15}Si_3C_{0.3}$ | 13.6 | 3.0 | 26.2 | 0.15 |
| Example 7 | $Fe_{bal.}B_{15}Si_{2.7}C_{0.3}P_{0.5}$ | 15.4 | 2.0 | 28.1 | 0.14 |
| Example 8 | $Fe_{bal.}B_{15}Si_4$ | 8.2 | 1.2 | 29.5 | 0.10 |
| Example 9 | $Fe_{bal.}B_{14}Si_4$ | 17.2 | 2.1 | 25.6 | 0.11 |
| Example 10 | $Fe_{bal.}B_{14}Si_4C_{0.2}$ | 7.4 | 2.2 | 15.0 | 0.08 |
| Example 11 | $Fe_{bal.}B_{14}Si_4Ni_1C_{0.2}$ | 7.0 | 2.3 | 22.5 | 0.04 |
| Example 12 | $Fe_{bal.}B_{14}Si_4Co_1C_{0.2}$ | 12.2 | 2.4 | 23.8 | 0.03 |
| Example 13 | $Fe_{bal.}B_{16}Si_3$ | 5.6 | 1.0 | 35.0 | 0.08 |
| Example 14 | $Fe_{bal.}B_{15.8}Si_2C_{0.2}$ | 3.6 | 1.6 | 32.1 | 0.10 |
| Example 15 | $Fe_{bal.}B_{15}Si_{2.7}Mn_{0.2}C_{0.2}$ | 3.8 | 2.5 | 25.6 | 0.12 |
| Example 16 | $Fe_{bal.}B_{15}Si_{2.7}Mn_{0.2}C_{0.2}Cr_{0.1}$ | 6.6 | 4.5 | 26.3 | 0.02 |
| Example 17 | $Fe_{bal.}B_{15}Si_{2.7}Mn_{0.2}C_{0.2}Sn_{0.1}$ | 9.0 | 5.0 | 24.9 | 0.15 |
| Example 18 | $Fe_{bal.}B_{15}Si_{2.7}Mn_{0.2}C_{0.2}Cu_{0.1}$ | 8.0 | 4.1 | 27.1 | 0.17 |
| Example 19 | $Fe_{bal.}B_{14}Si_{3.7}Mn_{0.2}C_{0.2}$ | 7.8 | 3.0 | 25.1 | 0.19 |
| Com. Ex. 3 | $Fe_{bal.}B_{15}Si_3C_{0.3}$ | 21.6 | 3.2 | 24.8 | 0.01 |
| Com. Ex. 4 | $Fe_{bal.}B_{11}Si_9C_{0.2}$ | 22.8 | 3.8 | 24.9 | 0.10 |
| Com. Ex. 5 | $Fe_{bal.}B_{15}Si_{2.7}Mn_{0.2}C_{0.2}$ | 24.4 | 6.1 | 25.6 | 0.24 |
| Com. Ex. 6 | $Fe_{bal.}B_{15}Si_{2.7}Mn_{0.2}C_{0.2}Cr_{0.1}$ | 24.6 | 6.9 | 25.3 | 0.31 |

Each Fe-based amorphous alloy ribbon of Examples 2-19 and Comparative Examples 3-6 was heat-treated at 350° C. for 60 minutes in a longitudinal magnetic field of 1000 A/m. A single sheet sample of each heat-treated Fe-based amorphous alloy ribbon was measured with respect to a DC B-H loop, to determine hysteresis loss $Ph_{1.3/50}$ at 1.3 T and 50 Hz. Further, the core loss $P_{1.3/50}$ and exciting power $S_{1.3/50}$ of each single sheet sample at 1.3 T and 50 Hz were measured by a single sheet tester. The results are shown in Table 3.

TABLE 3

| No. | $P_{h1.3/50}$ (W/kg) | $P_{1.3/50}$ (W/kg) | $S_{1.3/50}$ (VA/kg) |
|---|---|---|---|
| Example 2 | 0.031 | 0.052 | 0.060 |
| Example 3 | 0.030 | 0.048 | 0.052 |
| Example 4 | 0.023 | 0.051 | 0.071 |
| Example 5 | 0.030 | 0.050 | 0.050 |
| Example 6 | 0.032 | 0.060 | 0.058 |
| Example 7 | 0.040 | 0.071 | 0.061 |
| Example 8 | 0.031 | 0.051 | 0.049 |
| Example 9 | 0.040 | 0.072 | 0.058 |
| Example 10 | 0.024 | 0.047 | 0.049 |
| Example 11 | 0.024 | 0.047 | 0.050 |
| Example 12 | 0.033 | 0.062 | 0.060 |
| Example 13 | 0.028 | 0.068 | 0.073 |
| Example 14 | 0.028 | 0.062 | 0.067 |
| Example 15 | 0.024 | 0.048 | 0.051 |
| Example 16 | 0.028 | 0.068 | 0.072 |
| Example 17 | 0.033 | 0.070 | 0.073 |
| Example 18 | 0.029 | 0.069 | 0.072 |
| Example 19 | 0.025 | 0.051 | 0.051 |
| Com. Ex. 3 | 0.048 | 0.091 | 0.080 |
| Com. Ex. 4 | 0.049 | 0.093 | 0.090 |
| Com. Ex. 5 | 0.070 | 0.120 | 0.132 |
| Com. Ex. 6 | 0.074 | 0.130 | 0.141 |

As is clear from Table 3, the Fe-based amorphous alloy ribbons of Examples 2-19 were smaller than those of Comparative Examples 3-6 in both core loss $P_{1.3/50}$ and exciting power $S_{1.3/50}$. This is because the Fe-based amorphous alloy ribbons of Examples 2-19 had smaller hysteresis losses $Ph_{1.3/50}$ than those of the Fe-based amorphous alloy ribbons of Comparative Examples 3-6.

Examples 20-39

A ceramic-made melt nozzle 14 having a slit-shaped opening of 30 mm in length and 0.5-0.7 mm in width was used in the apparatus shown in FIG. 3(*a*), with a gap of 150-300 μm between a tip end of the melt nozzle 14 and a cooling roll 15. The water-cooling roll 15 made of a Cu—Be alloy was rotated at a peripheral speed of 20-35 m/s. While ejecting a carbon dioxide gas at 1250° C. from a heating nozzle 21, each alloy melt having the composition (atomic %) shown in Table 4 at 1250-1350° C. was ejected from the melt nozzle 14 onto the rotating water-cooling roll 15, to produce an Fe-based amorphous alloy ribbon of 30 mm in width. During the production of each Fe-based amorphous alloy ribbon, a transverse temperature distribution in the melt nozzle 14 was as extremely uniform as 1200° C.±10° C.

During the production of each Fe-based amorphous alloy ribbon, a wire brush roll 11 having stainless steel wires of 0.04 mm in diameter was rotated at a peripheral speed of 4 m/s in an opposite direction to the cooling roll 15. A surface of the cooling roll 15 ground by the wire brush roll 11 had fine linear scratches having an average roughness Ra of 0.5 μm and a maximum roughness depth Rmax of 2.5 μm. As a result, the attachment of oxides to the cooling roll 15 was suppressed.

Comparative Examples 7-10

Each Fe-based amorphous alloy ribbon was produced under the same conditions as in Examples 20-39, except that a heated carbon dioxide gas was not ejected from the heating nozzle 21. During the production of each Fe-based amorphous alloy ribbon, a transverse temperature distribution in the melt nozzle 14 was as large as 1200° C.±35° C.

During the production of each Fe-based amorphous alloy ribbon, a wire brush roll 11 having stainless steel wires of 0.08 mm in diameter was rotated at a peripheral speed of 5 m/s in an opposite direction to the cooling roll 15. A surface of the cooling roll 15 ground by the wire brush roll 11 had fine linear scratches having an average roughness Ra of 0.7 μm and a maximum roughness depth Rmax of 3.9 μm. As a result, the attachment of oxides to the cooling roll 15 was suppressed.

Any of the Fe-based amorphous alloy ribbons produced in Examples 20-39 and Comparative Examples 7-10 exhibited a halo pattern peculiar to the amorphous structure in X-ray diffraction. Each Fe-based amorphous alloy ribbon had the thickness T shown in Table 4. Wave-like undulations 2 on a free surface of each Fe-based amorphous alloy ribbon had continuous troughs 3 in a range corresponding to 95% of the ribbon width, the troughs 3 shown in Table 4 having an average amplitude D of 9.0 mm, an average longitudinal interval L of 2.9 mm, and an average t/T ratio of 0.1.

TABLE 4

| No. | Composition (atomic %) | D (mm) | L (mm) | T (μm) | t/T |
|---|---|---|---|---|---|
| Example 20 | $Fe_{bal.}B_{14}Si_4Cu_{1.3}$ | 8.0 | 2.0 | 21.3 | 0.08 |
| Example 21 | $Fe_{bal.}B_{12}Si_6Cu_{1.4}$ | 7.8 | 2.2 | 20.8 | 0.05 |
| Example 22 | $Fe_{bal.}B_{12}Si_6Cu_{1.5}C_{0.3}$ | 7.0 | 2.4 | 19.1 | 0.09 |
| Example 23 | $Fe_{bal.}B_{12}Si_6Cu_{1.4}Mn_{0.3}C_{0.3}$ | 8.6 | 1.9 | 20.8 | 0.10 |
| Example 24 | $Fe_{bal.}B_{12}Si_5Cu_{1.4}P_1C_{0.2}$ | 8.0 | 1.5 | 21.0 | 0.15 |

TABLE 4-continued

| No. | Composition (atomic %) | D (mm) | L (mm) | T (μm) | t/T |
|---|---|---|---|---|---|
| Example 25 | $Fe_{bal.}B_{12}Si_4Cu_{1.3}P_2$ | 7.6 | 1.2 | 22.8 | 0.18 |
| Example 26 | $Fe_{bal.}B_{14}Si_2Cu_{1.3}Mn_{0.2}P_4$ | 7.6 | 1.0 | 20.9 | 0.11 |
| Example 27 | $Fe_{bal.}B_{12}Si_3Cu_{1.3}Cr_{0.5}P_2$ | 8.4 | 2.2 | 20.7 | 0.12 |
| Example 28 | $Fe_{bal.}B_{12}Si_5Cu_{1.4}Nb_{0.5}Mn_{0.2}$ | 8.0 | 2.4 | 21.1 | 0.14 |
| Example 29 | $Fe_{bal.}B_{12}Si_6Cu_{1.4}Ni_1$ | 8.2 | 3.0 | 23.6 | 0.15 |
| Example 30 | $Fe_{bal.}B_{12}Si_6Cu_{1.4}Co_1$ | 7.8 | 4.1 | 22.1 | 0.14 |
| Example 31 | $Fe_{bal.}B_{12}Si_6Cu_{1.4}Mo_{0.3}C_{0.3}$ | 7.4 | 5.0 | 21.9 | 0.12 |
| Example 32 | $Fe_{bal.}B_{12}Si_6Cu_{1.4}C_{0.2}Sn_{0.1}$ | 7.0 | 4.3 | 21.8 | 0.10 |
| Example 33 | $Fe_{bal.}B_{12}Si_6Cu_{1.5}Co_{10}Ga_{0.1}$ | 4.4 | 3.3 | 20.9 | 0.09 |
| Example 34 | $Fe_{bal.}B_{12}Si_{5.5}Cu_{1.4}C_{0.2}Ge_{0.5}$ | 3.2 | 2.9 | 22.0 | 0.05 |
| Example 35 | $Fe_{bal.}B_{12}Si_{5.5}Cu_{1.4}C_{0.2}V_{0.5}$ | 15.6 | 4.2 | 21.3 | 0.04 |
| Example 36 | $Fe_{bal.}B_{12}Si_{5.5}Cu_{1.4}C_{0.2}S_{0.02}$ | 19.6 | 4.9 | 21.1 | 0.20 |
| Example 37 | $Fe_{bal.}B_{12}Si_5Cu_{1.4}P_{0.5}Zn_{0.1}$ | 14.4 | 4.0 | 20.9 | 0.18 |
| Example 38 | $Fe_{bal.}B_7Si_{15.5}Cu_{1.8}P_{0.2}$ | 11.2 | 3.2 | 17.8 | 0.15 |
| Example 39 | $Fe_{bal.}B_9Si_{13.5}Cu_{1.8}C_{0.2}$ | 9.6 | 2.9 | 17.5 | 0.12 |
| Com. Ex. 7 | $Fe_{bal.}B_{14}Si_4Cu_{1.3}$ | 25.2 | 6.1 | 22.3 | 0.01 |
| Com. Ex. 8 | $Fe_{bal.}B_{14}Si_4Ni_1Cu_{1.4}$ | 25.8 | 3.2 | 20.9 | 0.08 |
| Com. Ex. 9 | $Fe_{bal.}B_{12}Si_6Cu_{1.4}Ni_1$ | 26.0 | 5.5 | 21.2 | 0.25 |
| Com. Ex. 10 | $Fe_{bal.}B_{12}Si_3Cu_{1.3}Cr_{0.5}P_2$ | 23.6 | 0.8 | 22.4 | 0.28 |

Each Fe-based amorphous alloy ribbon of Examples 20-39 and Comparative Examples 7-10 was heat-treated at 350° C. for 60 minutes in a longitudinal magnetic field of 1000 A/m. X-ray diffraction revealed that crystal peaks corresponding to a bcc-Fe phase were observed in each heat-treated Fe-based amorphous alloy ribbon, indicating that its amorphous phase became less than 50%. The average crystal grain size determined from the half width of the bcc-Fe crystal peak by a Scherrer's equation was 30 nm or less.

A single sheet sample of each heat-treated Fe-based amorphous alloy ribbon was measured with respect to a DC B-H loop to determine hysteresis loss $Ph_{1.3/50}$ at 1.3 T and 50 Hz. Further, the core loss $P_{1.3/50}$ and exciting power $S_{1.3/50}$ of each single sheet sample at 1.3 T and 50 Hz were measured by a single sheet tester. The results are shown in Table 5.

TABLE 5

| No. | $P_{h1.3/50}$ (W/kg) | $P_{1.3/50}$ (W/kg) | $S_{1.3/50}$ (VA/kg) |
|---|---|---|---|
| Example 20 | 0.0281 | 0.0301 | 0.0302 |
| Example 21 | 0.0271 | 0.0360 | 0.0362 |
| Example 22 | 0.0300 | 0.0332 | 0.0333 |
| Example 23 | 0.0362 | 0.0381 | 0.0385 |
| Example 24 | 0.0329 | 0.0349 | 0.0342 |
| Example 25 | 0.0320 | 0.0338 | 0.0345 |
| Example 26 | 0.0331 | 0.0340 | 0.0344 |
| Example 27 | 0.0339 | 0.0367 | 0.0358 |
| Example 28 | 0.0341 | 0.0359 | 0.0360 |
| Example 29 | 0.0352 | 0.0370 | 0.0371 |
| Example 30 | 0.0344 | 0.0361 | 0.0362 |
| Example 31 | 0.0330 | 0.0368 | 0.0370 |
| Example 32 | 0.0328 | 0.0358 | 0.0361 |
| Example 33 | 0.0331 | 0.0340 | 0.0345 |
| Example 34 | 0.0332 | 0.0341 | 0.0342 |
| Example 35 | 0.0367 | 0.0400 | 0.0401 |
| Example 36 | 0.0510 | 0.0551 | 0.0552 |
| Example 37 | 0.0482 | 0.0510 | 0.0521 |
| Example 38 | 0.0339 | 0.0457 | 0.0463 |
| Example 39 | 0.0421 | 0.0449 | 0.0453 |
| Com. Ex. 7 | 0.0552 | 0.0581 | 0.1632 |
| Com. Ex. 8 | 0.0541 | 0.0572 | 0.1691 |
| Com. Ex. 9 | 0.0560 | 0.0593 | 0.1720 |
| Com. Ex. 10 | 0.0569 | 0.0612 | 0.1092 |

As is clear from Table 5, the core losses P1.3/50 and exciting powers S1.3/50 of the Fe-based amorphous alloy ribbons of Examples 20-39 were smaller than those of the Fe-based amorphous alloy ribbons of Comparative Examples 7-10. This is because the Fe-based amorphous alloy ribbons of Examples 20-39 were smaller in hysteresis loss $Ph_{1.3/50}$ than the Fe-based amorphous alloy ribbons of Comparative Examples 7-10.

Example 40

A ceramic-made melt nozzle 14 having a slit-shaped opening of 25 mm in length and 0.6 mm in width was used in the apparatus shown in FIG. 3(*a*), with a gap of 240 μm between a tip end of the melt nozzle 14 and a cooling roll 15. The water-cooling roll 15 made of a Cu—Cr alloy was rotated at a peripheral speed of 25.5 m/s. While ejecting a carbon dioxide gas at 1250° C. from a heating nozzle 21, an alloy melt at 1280° C., which comprised 15.1 atomic % of B, 3.5 atomic % of Si and 0.2 atomic % of C, the balance being substantially Fe and inevitable impurities, was ejected from the melt nozzle 14 onto the rotating water-cooling roll 15, to produce an Fe-based amorphous alloy ribbon of 25 mm in width and 24.7 μm in average thickness. During the production of the Fe-based amorphous alloy ribbon, a transverse temperature distribution in the melt nozzle 14 was as extremely uniform as 1195° C.±10° C.

During the production of the Fe-based amorphous alloy ribbon, a wire brush roll 11 having stainless steel wires of 0.09 mm in diameter was rotated at a peripheral speed of 6 m/s in an opposite direction to the cooling roll 15. A surface of the cooling roll 15 ground by the wire brush roll 11 had fine linear scratches having an average roughness Ra of 1 μm and a maximum roughness depth Rmax of 5 μm. As a result, the attachment of oxides to the cooling roll 15 was suppressed.

The resultant Fe-based amorphous alloy ribbon exhibited a halo pattern peculiar to the amorphous structure in X-ray diffraction. Wave-like undulations 2 on a free surface of the Fe-based amorphous alloy ribbon had continuous troughs 3 in a range corresponding to 80% of the ribbon width, the troughs 3 having an average amplitude D of 7.4 mm and an average longitudinal interval L of 2.0 mm, and the average height difference t between the troughs 3 and ridges 4 being 3.0 μm or less.

This Fe-based amorphous alloy ribbon was wound to produce a wound core of Example 40 having outer diameter of 75 mm and an inner diameter of 70 mm. While applying a magnetic field of 1000 μm in a magnetic path direction, it was heat-treated at 330° C. for 60 minutes. Each of the temperature-elevating speed and the cooling speed was 5° C./minute. The DC B-H loop of the heat-treated wound core was measured to determine hysteresis loss $Ph_{1.3/50}$ at 1.3 T and 50 Hz. Evaluation of AC magnetic properties revealed that the wound core had a core loss of 0.055 W/kg and an exciting power $S_{1.3/50}$ of 0.073 VA/kg at 1.3 T and 50 Hz.

Comparative Example 11

Using an Fe-based amorphous alloy ribbon produced under the same conditions as in Example 40 except that a heated carbon dioxide gas was not ejected from the heating nozzle 21, a wound core was produced. Wave-like undulations 2 on a free surface of the Fe-based amorphous alloy ribbon had troughs 3 having an average amplitude D of 24.6 mm. The wound core had a core loss $P_{1.3/50}$ of 0.103 W/kg and an exciting power $S_{1.3/50}$ of 0.123 VA/kg at 1.3 T and 50 Hz. This indicates that wound cores would have large core loss and exciting power if the requirements of the present invention were not met.

Effect of the Invention

Because the quenched, Fe-based soft-magnetic alloy ribbon of the present invention has wave-like undulations on a free surface, the wave-like undulations having transverse troughs arranged at substantially constant intervals in a longitudinal direction, and the troughs having an average amplitude D of 20 mm or less, it has reduced eddy current loss and suppressed hysteresis loss, thereby exhibiting extremely low core loss. Cores obtained by laminating or winding such quenched, Fe-based soft-magnetic alloy ribbons have high efficiency because of low core loss, and low noise because of low apparent power, suitable for distribution transformers, various reactors, choke coils, magnetic switches, etc.

What is claimed is:

1. A method for producing a quenched Fe-based amorphous alloy ribbon having wave-like undulations on a free surface by a single roll method, said wave-like undulations having transverse troughs arranged at longitudinal intervals, and said troughs having an average amplitude D of 20 mm or less, the method comprising the steps of (a) keeping a transverse temperature distribution in a melt nozzle within ±15° C. by using a heating nozzle having a slit-shaped opening for blowing a heating gas onto the melt nozzle, the length of the slit-shaped opening of the heating nozzle being 1.2-2 times the horizontal length of a slit-shaped orifice of the melt nozzle, the temperature of a heating gas ejected from the heating nozzle being 1000-1400° C.; and (b) forming numerous linear scratches on a cooling roll surface by a wire brush, thereby providing a ground surface of said cooling roll with an arithmetical mean (average) roughness Ra of 0.1-1 μm and a maximum roughness depth Rmax of 0.5-10 μm.

2. The method for producing a quenched Fe-based amorphous alloy ribbon according to claim 1, wherein a hood is disposed, the melt nozzle and the heating nozzle being positioned in the hood, a gap being formed between the hood and the cooling roll.

3. The method for producing a quenched Fe-based amorphous alloy ribbon according to claim 1, said wave-like undulations having ridges, wherein each of the ridges extends in a transverse direction in regions longitudinally adjacent to a trough.

4. The method for producing a quenched Fe-based amorphous alloy ribbon according to claim 1, wherein regions having said troughs occupy 70% or more of the width of said ribbon, as determined by selecting five arbitrary regions of 50 mm long on the ribbon in a longitudinal direction and averaging transverse-direction occupancy ratios measured in these regions.

5. The method for producing a quenched Fe-based amorphous alloy ribbon according to claim 1, wherein said troughs continuously extend the entire width of said ribbon.

6. The method for producing a quenched Fe-based amorphous alloy ribbon according to claim 1, wherein said troughs have longitudinal intervals L in a range of 1-5 mm; and wherein said ribbon has a thickness T in a range of 15-35 μm.

7. The method for producing a quenched Fe-based amorphous alloy ribbon according to claim 1, wherein a ratio t/T of an average height difference t between said troughs and said ridges to the thickness of said ribbon is in a range of 0.02-0.2.

8. The method for producing a quenched Fe-based amorphous alloy ribbon according to claim 1, wherein the transverse troughs are curved like waves.

9. A method for producing a core, comprising forming a quenched Fe-based amorphous alloy ribbon by the method recited in claim 1, and laminating or winding the quenched Fe-based soft-magnetic alloy ribbon.

* * * * *